US006213187B1

(12) United States Patent
Hughes

(10) Patent No.: US 6,213,187 B1
(45) Date of Patent: Apr. 10, 2001

(54) REPLACEMENT WINDOW WITH SHUTTER

(76) Inventor: Gary M Hughes, 4110 Aliikoa Pl., Haiku, HI (US) 96708

( * ) Notice: Subject to any disclaimer, the term of this patent is extended or adjusted under 35 U.S.C. 154(b) by 0 days.

(21) Appl. No.: 09/363,738

(22) Filed: Jul. 30, 1999

(51) Int. Cl.[7] ..... A47H 1/00; E06B 7/08

(52) U.S. Cl. ..... 160/90; 160/104; 160/206; 49/64

(58) Field of Search ..... 160/90, 89, 206, 160/104; 49/64, 61, 63, 77.1, 87.1, 74.1, 403, 404

(56) References Cited

U.S. PATENT DOCUMENTS

| | | | | |
|---|---|---|---|---|
| 1,245,042 | * | 10/1917 | Schoening et al. | 160/206 |
| 2,699,204 | * | 1/1955 | Davis | 49/63 X |
| 2,869,187 | | 1/1959 | Liebman et al. . | |
| 3,020,951 | * | 2/1962 | Graulich | 49/63 X |
| 4,098,027 | * | 7/1978 | Crance | 160/90 X |
| 4,251,966 | | 2/1981 | Foltman . | |
| 4,991,349 | | 2/1991 | Barthelemy . | |
| 5,524,390 | * | 6/1996 | Christensen | 49/463 |
| 5,659,999 | | 8/1997 | Benson . | |
| 5,768,834 | | 6/1998 | Pinder . | |
| 5,887,386 | * | 3/1999 | Alexanian et al. | 49/403 |
| 5,893,242 | | 4/1999 | Perron . | |

* cited by examiner

*Primary Examiner*—Daniel P. Stodola
*Assistant Examiner*—Hugh B. Thompson
(74) *Attorney, Agent, or Firm*—Michael I. Kroll

(57) ABSTRACT

A new or replacement window having a window frame in which is mounted shutters, windows, and a screen. The frame has multiple tracks for receiving slidable shutters, a slidable window occupying half the length of the track, and a stationary frame being occupied half by a screen and half by a window. The shutters have horizontal slats some of which are rotatable.

4 Claims, 10 Drawing Sheets

REPLACEMENT WINDOW WITH SHUTTER

BACKGROUND OF THE INVENTION

1. Field of the Invention

The present invention relates generally to windows and, more specifically, to a new or replacement window comprising a new or replacement window frame member and a number of selectively movable members traveling within individual tracks and selectively removable from said tracks. The movable members are comprised of a pair of shutter members, a pair of window pane members, and a screen member.

Each of the shutter members is comprised of a frame having a plurality of rotative horizontal slats. Further having a tilt bar connected to a plurality of horizontal slats providing means for rotating said plurality at the same time.

Each of the window pane members is comprised of a pane of transparent material, such as glass or plastic, enclosed within a rigid frame. The screen member is comprised of screen material encompassed by a rigid frame.

The preferred embodiment of the window frame member has a flange having a number of fastener apertures providing means for securing said replacement window frame to a rough opening. An additional embodiment for the replacement window frame has an extended jamb providing means for securing said replacement window frame to the walls of the rough opening instead of the external facing of the rough opening.

In addition an alternate embodiment for the shutters is provided wherein the two shutter members are replaced by a single track bifold shutter member.

Additionally there is provided an alternate embodiment of the present invention having a window frame having an exterior shutter member and two interior window pane members, one slidable for ventilation and one nonslidable. Also there is provided an exterior screen member to prevent entry of insects.

2. Description of the Prior Art

There are other shutter and horizontal sliding member windows. Typical of these is U.S. Pat. No. 5,893,242 issued to Perron on Apr. 13, 1999.

Another patent was issued to Pinder on Jun. 23, 1998 as U.S. Pat. No. 5,768,834. Yet another U.S. Pat. No. 5,659,999 was issued to Benson on Aug. 26, 1997 and still yet another was issued on Feb. 12, 1991 to Barthelemy as U.S. Pat. No. 4,991,349.

Another patent was issued to Liebman et al on Jan. 20, 1959 as U.S. Pat. No. 2,869,187. Yet another U.S. Pat. No. 4,251,966 was issued to Foltman on Feb. 24, 1981.

Perron discloses a shutter assembly for installation on the outside of a building wall including one or two shutter panels fitted with top and bottom rollers moveable along tracks in a plane outwardly spaced from and parallel to the external wall. A rack is carried by each panel inside thereof and a pinion, meshing with the rack, is carried by a shaft extending through the wall and provided at its inner end, inside a building room with a crank reel for moving the shutter panels between opened and closed position at the side and front of a window respectively. The shutter panels are heat-insulated and are provided with seals to extend around the periphery of the window opening when the panels are in closed position to thereby form an air insulating chamber with a window unit within the window opening. The top rollers together with the rack are fitted with a spring suspension to permit easy installation and removal of the rollers on and from the tracks and to accommodate any variation in the vertical position of the pinion which may have occurred during installation.

Pinder discloses a rain deflector for a vehicle roof vent consists of a pair of like panels one of which is fastened to the cap of thee roof vent and moves therewith, and is hinged to the second panel which has the end remote from the hinge connected to slide along tracks on the vehicle roof. Each panel is substantially larger than the vent cap, to extend beyond the ridges of the vent and prevents rain from entering the vent while permitting ventilation of air through the vent.

Benson discloses an automatic closure assembly for a sliding panel, particularly of the screen door type. One or more power springs, operable in their linear ranges are mounted within a compact housing configured for ready attachment to a surface adjacent the sliding panel. The springs apply tension to a cord wound on a take-up reel within the housing. One end of the cord is screwed to the sliding panel such that as the panel is moved in an opening direction, the power spring(s) are wound in tension to apply closure forces to the panel. Different selections are provided for enabling an operator to select a plurality of different discrete tension forces to be applied by the closure assembly to the sliding panel.

Barthelemy discoses an insulative window assembly for use in portable shelter units such as mobile homes, motor homes and trailers. The assembly is attached to the inside wall of the portable shelter unit surrounding the existing window and window molding, but may be easily removed in warm seasons to regain access to the existing window. The frame of the insulating window assembly is of sufficient depth to allow room for the stem of the crank to which the crank handle is attached for opening and closing of jalouise window assembly. The frame of the insulating window assembly contains insulating, sag resisting chambers which contribute to the heat insulative properties of the insulating window. The frame also contains an inner flange and an outer flange which, when bolted to the inside wall of the portable shelter unit, lends stability to the unit and helps prevent the sag and broken seals that frequently results from the vibration and weather forces to which portable shelter units are particular vulnerable.

Liebman et al disclose a window construction wherein the frame work is substantially of stainless steel or other materials having substantially the same physical properties and including a permanently fixed window half-section and a slidable window half-section adjustable to the location over the fixed window half-section and wherein a screen member is fitted in the opening beside the fixed window half-section. In addition the slidable window section can be easily removed from the guide projections for removal or replacement.

Foltman discloses a shutter comprised of laterally spaced apart extruded plastic side frame members or rails having a track on their respective rear sides which extends over the length of the member. Panels, such as louvre panels, have runners which slide on the tracks in interlocking fashion to form a shutter assembly. The shutters are adjustable to any desired window or door height by cutting off parts of the runners of the louvre panels so as to eliminate one or more louvre slats and also cutting off an equal length from the frame member. The upper and lower end panels are secured with pins which pass through the frame members so the panels cannot slide from the tracks.

While these shutter and horizontal sliding member windows may be suitable for the purposes for which they were designed, they would not be as suitable for the purposes of the present invention, as hereinafter described.

SUMMARY OF THE PRESENT INVENTION

The present invention discloses a new or replacement window having a single window frame within which are mounted shutters, windows and a screen. Embodiments are disclosed for a unit having a plurality of tracks therein for receiving a pair of slidably mounted shutters, a pair of slidably mounted windows and a screen. A tilt bar is disclosed for rotating a multiplicity of slats in the shutters. A plurality of spring tensioned pins are described for rotatably mounting the slats to the window frame. Another embodiment is described having bi-fold shutters hingedly mounted to each other. Also, another embodiment is described wherein the shutters are a single non-sliding member and only one window unit slides.

A primary object of the present invention is to provide a new or replacement window having horizontally sliding members.

Another object of the present invention is to provide a new or replacement window having a pair of horizontally sliding shutter members.

Yet another object of the present invention is to provide a new or replacement window having a pair of horizontally sliding shutter members having a roller or rollers within the base edge forming an integral part of said shutter members providing means for effortlessly moving said shutter members;

Still yet another object of the present invention is to provide a new or replacement window having a pair of horizontally sliding shutter members. Each member having a plurality of rotative horizontal slats;

Another object of the present invention is to provide a new or replacement window having a pair of horizontally sliding shutter members. Each member having a plurality of rotative horizontal slats. Each slat having a fixed pin on one end and a spring based pin on the other end whereby each slat is selectively removable;

Yet another object of the present invention is to provide a new or replacement window having a pair of horizontally sliding shutter members. Each member having a tilt bar connected to a plurality of rotative horizontal slats providing means for selectively positioning a plurality of slats at one time.

Additional objects of the present invention will appear as the description proceeds.

The present invention overcomes the shortcomings of the prior art by providing a new or replacement window comprising a new or replacement window frame member and a number of selectively movable members traveling within individual tracks and each selectively removable from the track. Said movable members are comprised of a pair of shutters, a pair of window pane members, and a screen member. Each of the shutter members is comprised of a frame having a plurality of rotative horizontal slats. Further having a tilt bar connected to a plurality of horizontal slats providing means for rotating said plurality at the same time. Each of the window pane members is comprised of a pane of transparent material, such as glass or plastic, enclosed within a rigid frame. The screen member is comprised of screen material encompassed by a rigid frame. The preferred embodiment of the window frame member has a flange having a number of fastener slots providing means for securing said new or replacement window frame to a rough opening. An additional embodiment for the new or replacement window frame has an extended jamb providing means for securing said new or replacement window frame to the walls of the rough opening instead of the facing of the rough opening. In addition an alternate embodiment for the shutters is provided wherein the two shutter members are replaced by a single track bifold shutter member. Additionally there is an alternate embodiment of the present invention having a window frame having an exterior shutter member and two interior window pane members, one slidable for ventilation and one nonslidable. Also there is an exterior screen member to prevent entry of insects.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE PREFERRED EMBODIMENT(S)

In order that the invention may be more fully understood, it will now be described, by way of example, with reference to the accompanying drawings in which FIGS. 1 through 10 illustrate the present invention being a new or replacement window.

Figure 1:
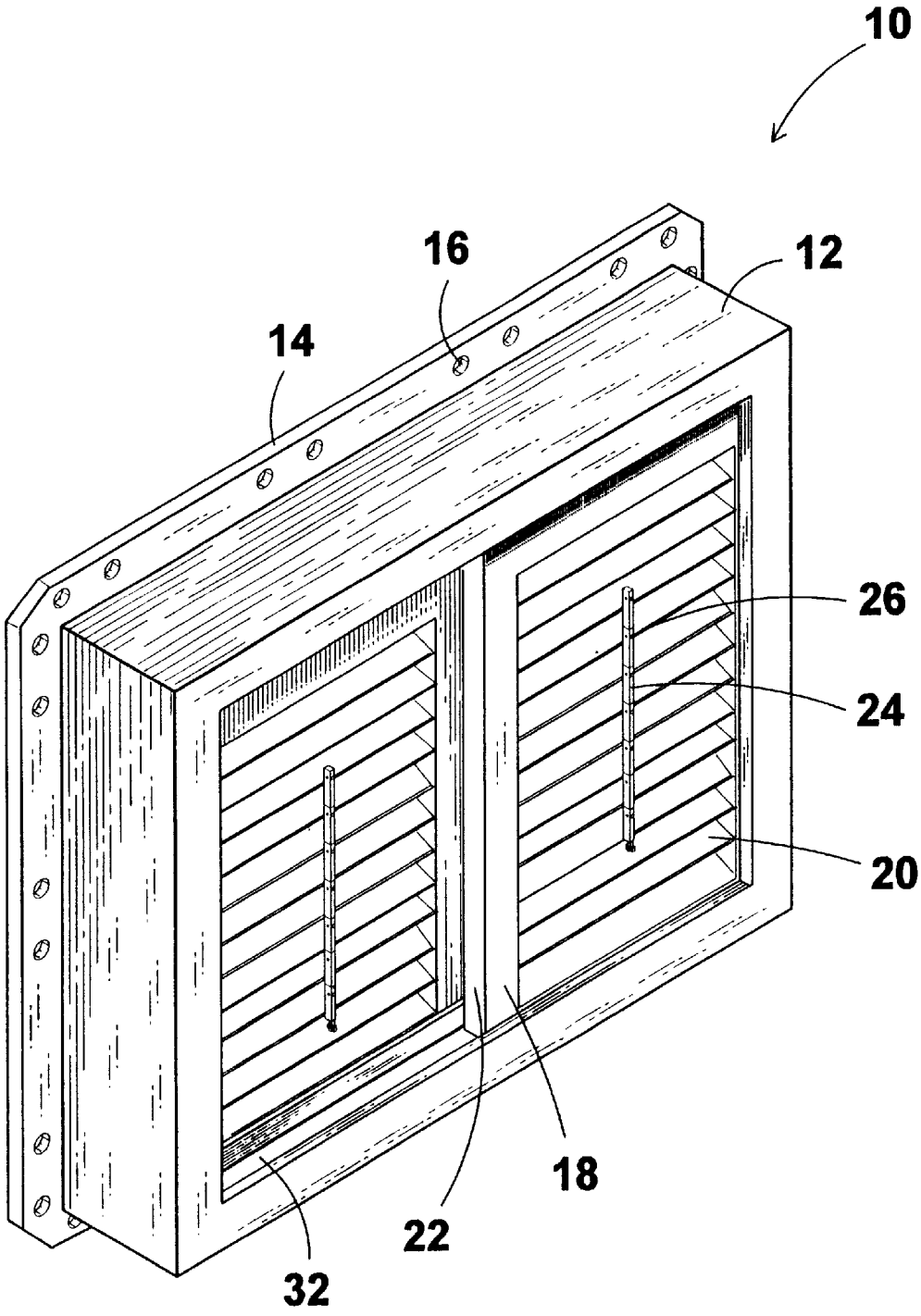
FIG. 1 is a perspective view of the preferred embodiment of the present invention.

Turning to FIG. 1, shown therein is a perspective view of the preferred embodiment of the present invention 10. Shown is a new or replacement window outer frame member 12 having a flange 14 thereon around the peripheral edge thereof having a plurality of spaced about apertures 16 for receiving fastener means (not shown) therein providing means for securing said new or replacement window 10 to the facing wall (not shown) of a rough opening (not shown). The new or replacement window 10 comprises a pair of movable window members (not shown) and a movable screen member (not shown). Shown are a pair of sliding shutter members 18 slidably movable in individual track 32. Each shutter member 18 has a plurality of rotative generally horizontal slats 20 encompassed by a slat frame 22 and having a generally upright standing tilt bar 24 connected by means 26 to a plurality of slats 20 providing means for selectively rotatably positioning a plurality of slats 20 at the same time. The slats 20 rotate about its generally horizontal axis.

Figure 2:
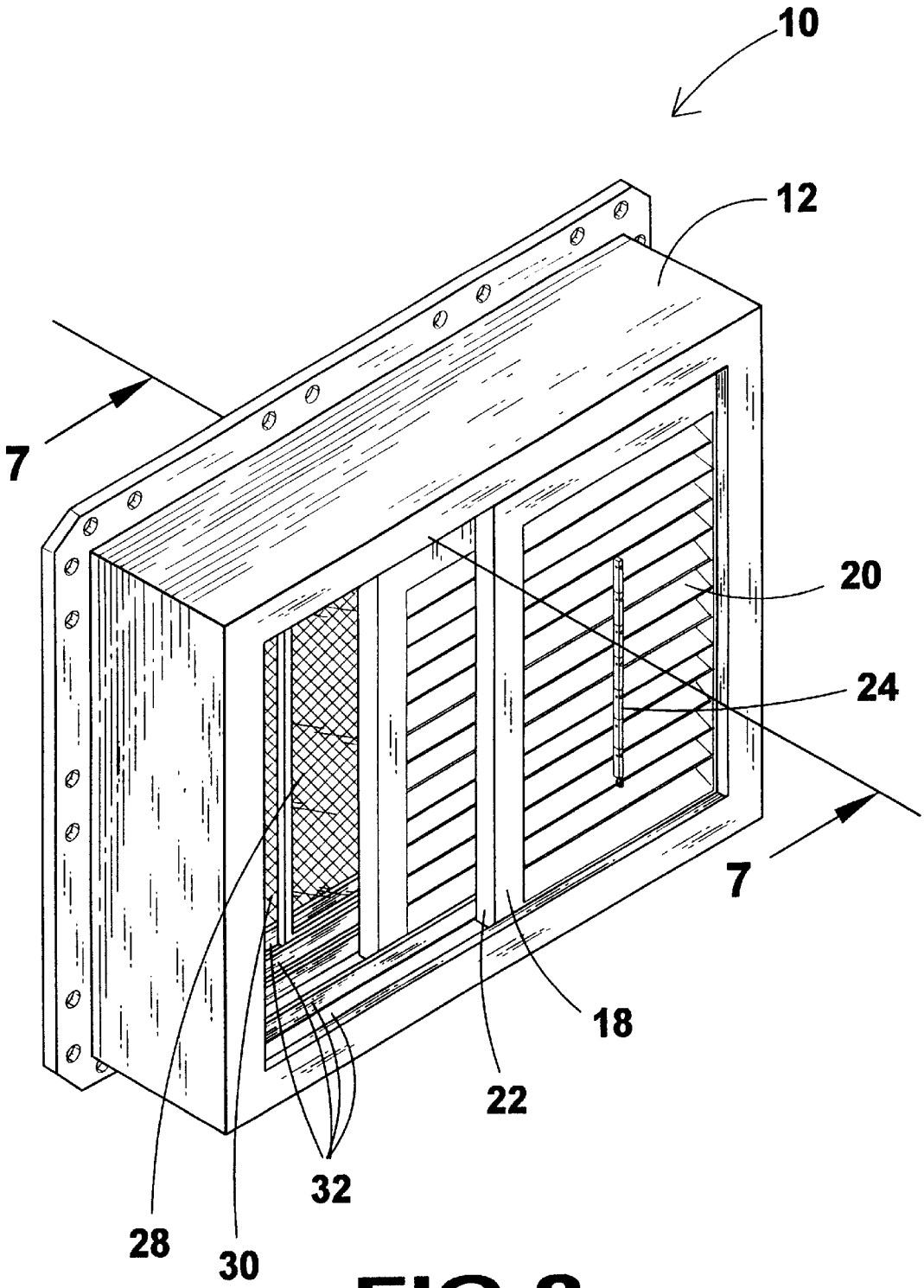
FIG. 2 is a perspective view of the present invention.

Turning to FIG. 2, shown therein is a perspective view of the present invention 10. Shown is the new or replacement window frame 12 having a pair of selectively slidable shutters 18 comprising a plurality of horizontal slats 20 encompassed by a frame 22. Each shutter member 18 has a tilt bar 24 connected to a plurality of rotative horizontal slats 20 providing means for selectively positioning the plurality of slats 20 at the same time. The new or replacement window 10 has a pair of selectively slidable window members 28 and a screen member 30 which can be moved to cover the ventilation opening created by an open window member. The frame 12 has multiple tracks 32 mounted thereon within which shutters 18, windows 28 and screen 30 are mounted within a single frame 12.

Figure 3:
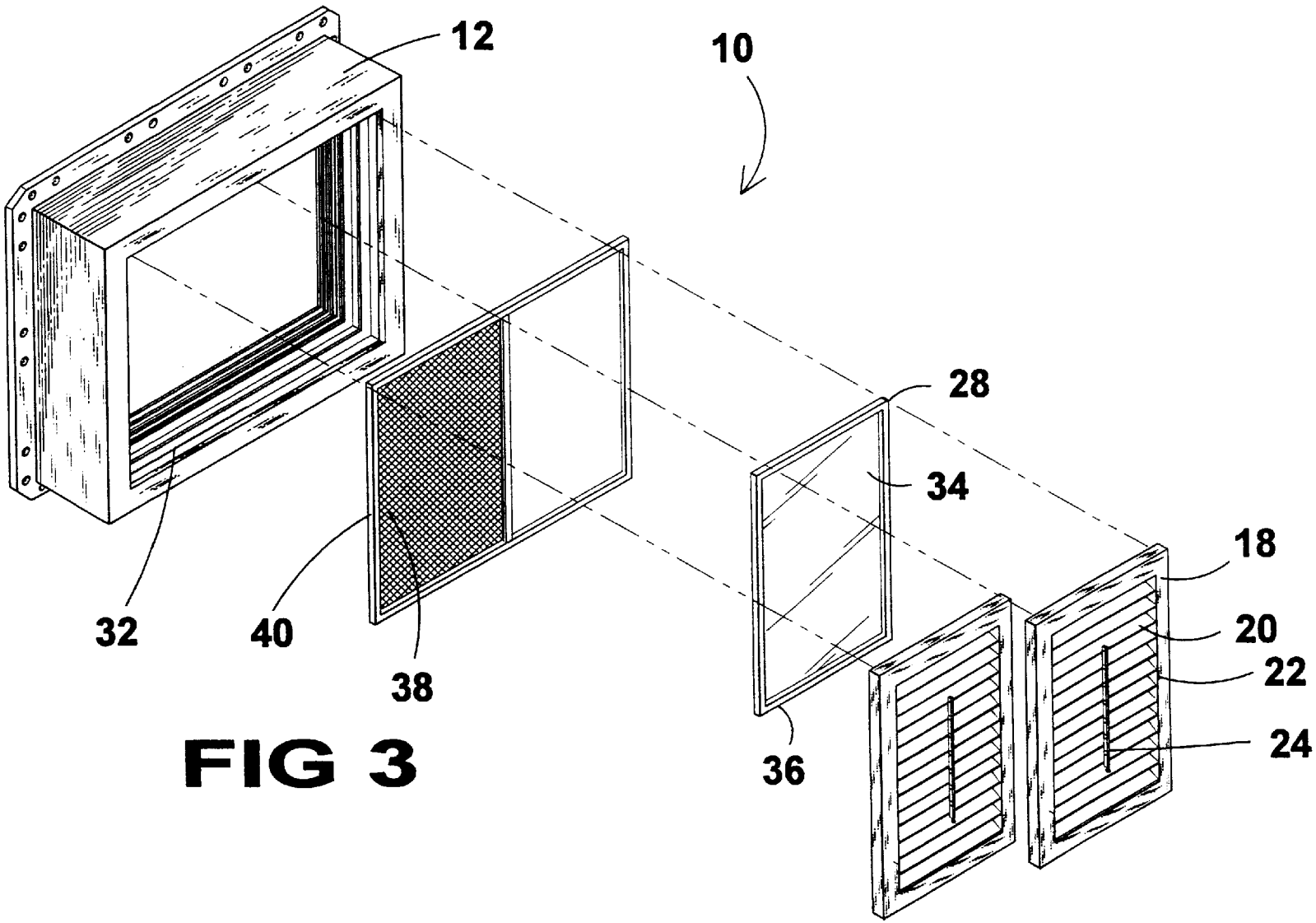
FIG. 3 is an exploded view of the preferred embodiment of the present invention.

Turning to FIG. 3, shown therein is an exploded view of the preferred embodiment of the present invention 10. Shown is a new or replacement window 10 comprising a new or replacement window outer frame member 12, a pair of shutter members 18, a pair of window pane members 28, and a screen member 30. One of the pair of window pane members 28 is mounted within the frame 40 of the screen 38. One window pane member 28 is slidable. Each of the shutter members 18 is comprised of a frame 22 having a plurality of rotative horizontal slats 20 and a tilt bar 24 connected to a plurality of horizontal slats 20 providing means for rotating the plurality of slats 20 at the same time. Each of the window pane members 28 is comprised of a pane of transparent material 34, such as glass or plastic, and one member is enclosed within a rigid frame 36. The screen member 30 is comprised of screen material 38 encompassed by a rigid frame 40 which also holds one window pane. Multiple tracks 32 are also shown as previously disclosed.

Figure 4:
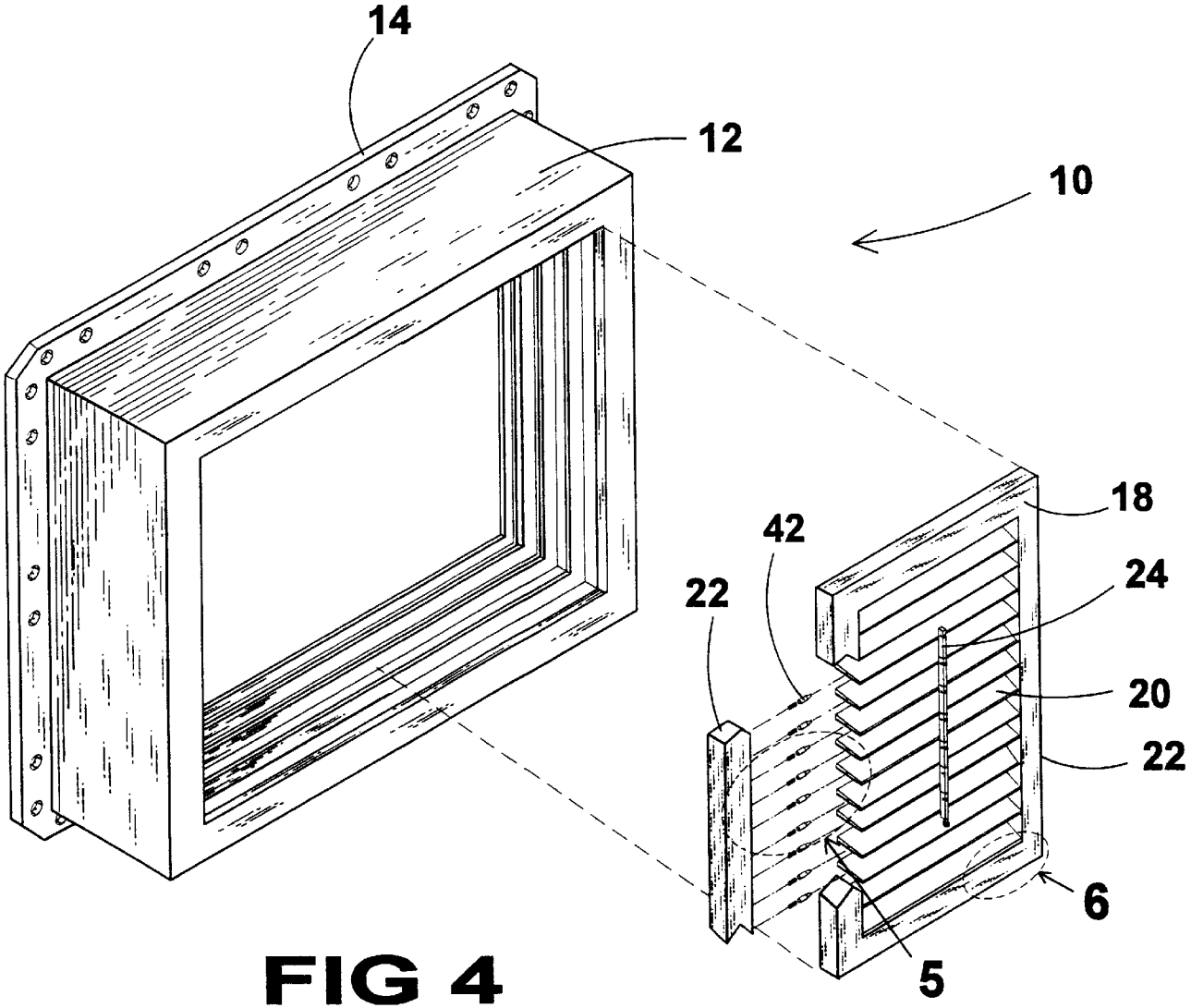
FIG. 4 is a perspective view of the new or replacement window frame having a flange providing means for attaching said new or replacement window to the rough opening.

Turning to FIG. 4, shown therein is a perspective view of the new or replacement window frame 12 having a flange 14 providing means for attaching the replacement window 10 to a rough opening. Also shown is one of the shutters 18 having means for rotating 24 a plurality of horizontal slats 20. Each of the horizontal slats 20 is rotatably fixed to the frame 22 by means of pins 42 which extend from the frame 22 into each end of the slat 20. On one side of the frame 22 the pins 42 are maintained under spring pressure which will be described hereinafter providing means for removing or selectively replacing one or more of the horizontal slat 20.

Figure 5:
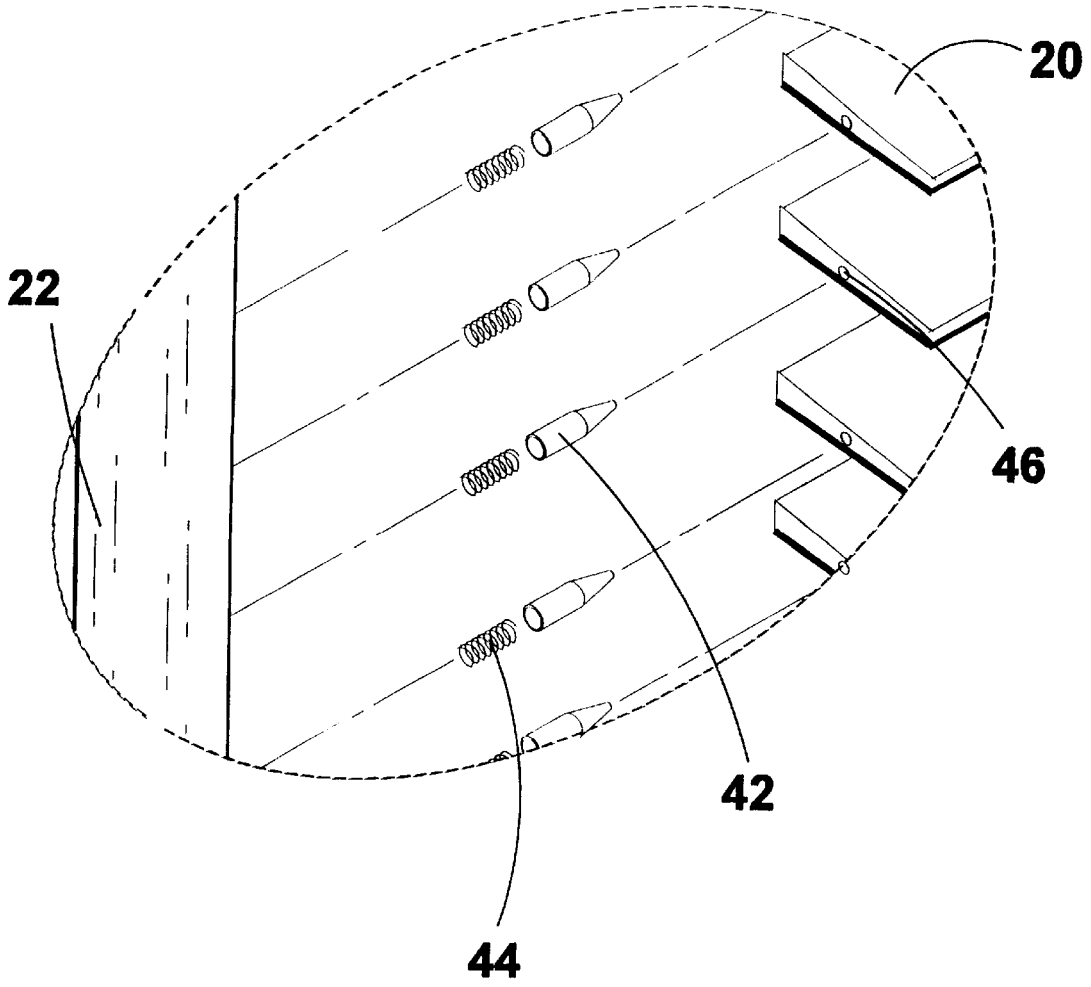
FIG. 5 is an enlarged view of the spring and pin elements of the horizontal slat.

Turning to FIG. 5, shown therein is an enlarged view of the spring 44 and pin 42 elements of the horizontal slat 20 in frame 22 taken from FIG. 4 as indicated. The generally horizontal spring 44 will maintain or tension the pin 42 within the aperture 46 in the end of the horizontal slat 20. Selective removal of a horizontal slat 20 is accomplished by moving the slat 20 toward the spring 44 tensioned side until the opposite end of the slat is free of its pin element (not shown) which allows the slat 20 to be swung out and removed from the shutter frame 22. Multiple apertures (not shown) are provided on the inner face in the frame 22 on each end of slats 20 for receiving the spring 44 and pin 42. Pins 42 communicate with frame 12 and slats 20.

Figure 6:
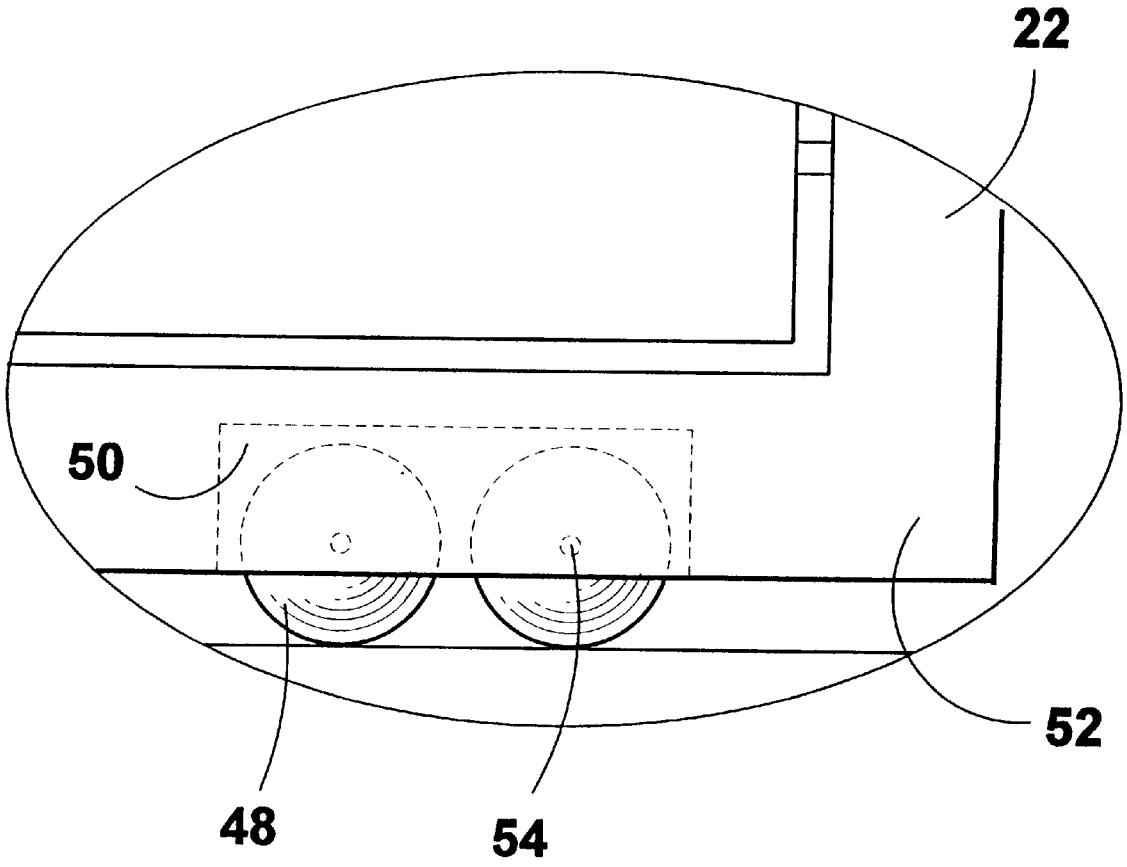
FIG. 6 is an enlarged view of the base of the shutter showing a roller element providing means for sliding said shutter to a selected position.

Turning to FIG. 6, shown therein is an enlarged view of the lower edge of the frame 22 or base 52 of the shutter taken from FIG. 4 as indicated showing a multiple roller element 48 providing means for sliding said shutter 18 to a selected position in the track 32. A cavity 50 is provided in the base 52 of the frame 22 for receiving rollers 48. Rollers 48 are mounted on an axle 54 which is mounted in base 52.

Figure 7:
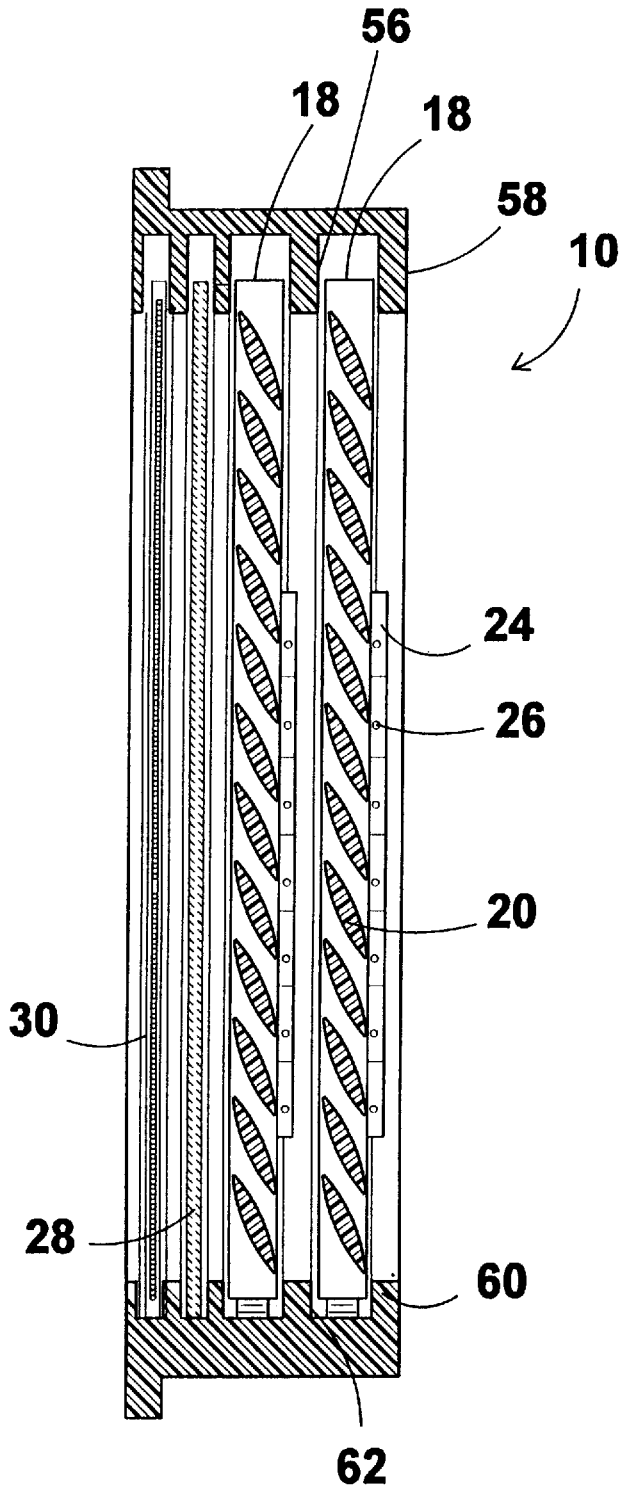
FIG. 7 is a cross sectional view of the present invention taken from FIG. 2 as indicated.

Turning to FIG. 7, shown therein is a cross sectional view of the present invention 10 taken from FIG. 2 as indicated. Shown are the elements of the new or replacement window 10 comprising a pair of shutters 18 having means for sliding said shutter 18 to a selected position and said shutter 18 having means 24 for rotating a plurality of horizontal slats 20 from one position to another said means for rotating 24 having means for connection 26 to the slats 20. Further elements of the new or replacement window 10 are one slidable window pane member 34 which can be selectively positioned to allow ventilation and a screen member 30 which has one window pane member 28 positioned in its frame. The slidable members have a track wall 56 which is taller or deeper at the top 58 than at the bottom 60 whereby the elements 20, 28 and 30 can be raised vertically until the bottom edge of said elements clears the bottom track wall 62 where it can bc swung forwardly out and removed.

Figure 8:
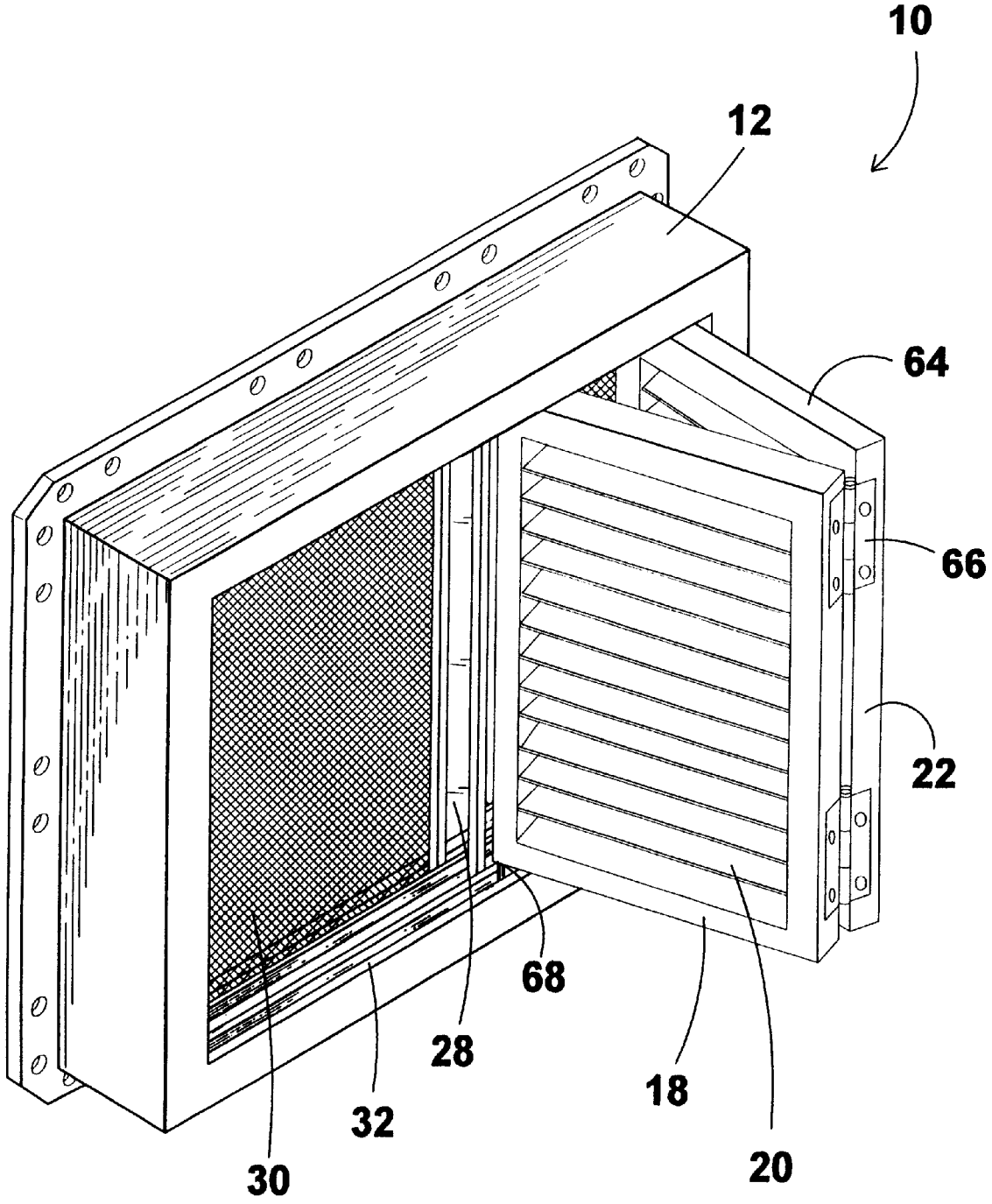
FIG. 8 is a perspective view of the alternate embodiment of the present invention.

Turning to FIG. 8, shown therein is a perspective view of the alternate embodiment of the present invention 10. Shown is a new or replacement window frame 12 comprising a pair of movable window members 28 and a movable screen member 30 and a single track bi-fold shutter member 64. One window pane member 28 is mounted in the same frame as the screen member 30. One window pane member 28 is slidable. The bi-fold shutter member 64 is comprised of two hingedly attached 66 shutter elements 18. Each shutter element 18 having a plurality of rotative horizontal slats 20 encompassed by a frame 22 and having a tilt bar (not shown) connected to a plurality of said slats 20 providing means for selectively positioning a plurality of slats 20 at the same time. Means 68, e.g., a pin, is positioned at the top and bottom of shutter frame 22 for slidably positioning the shutters 64 in tracks 32 is also shown.

Figure 9:
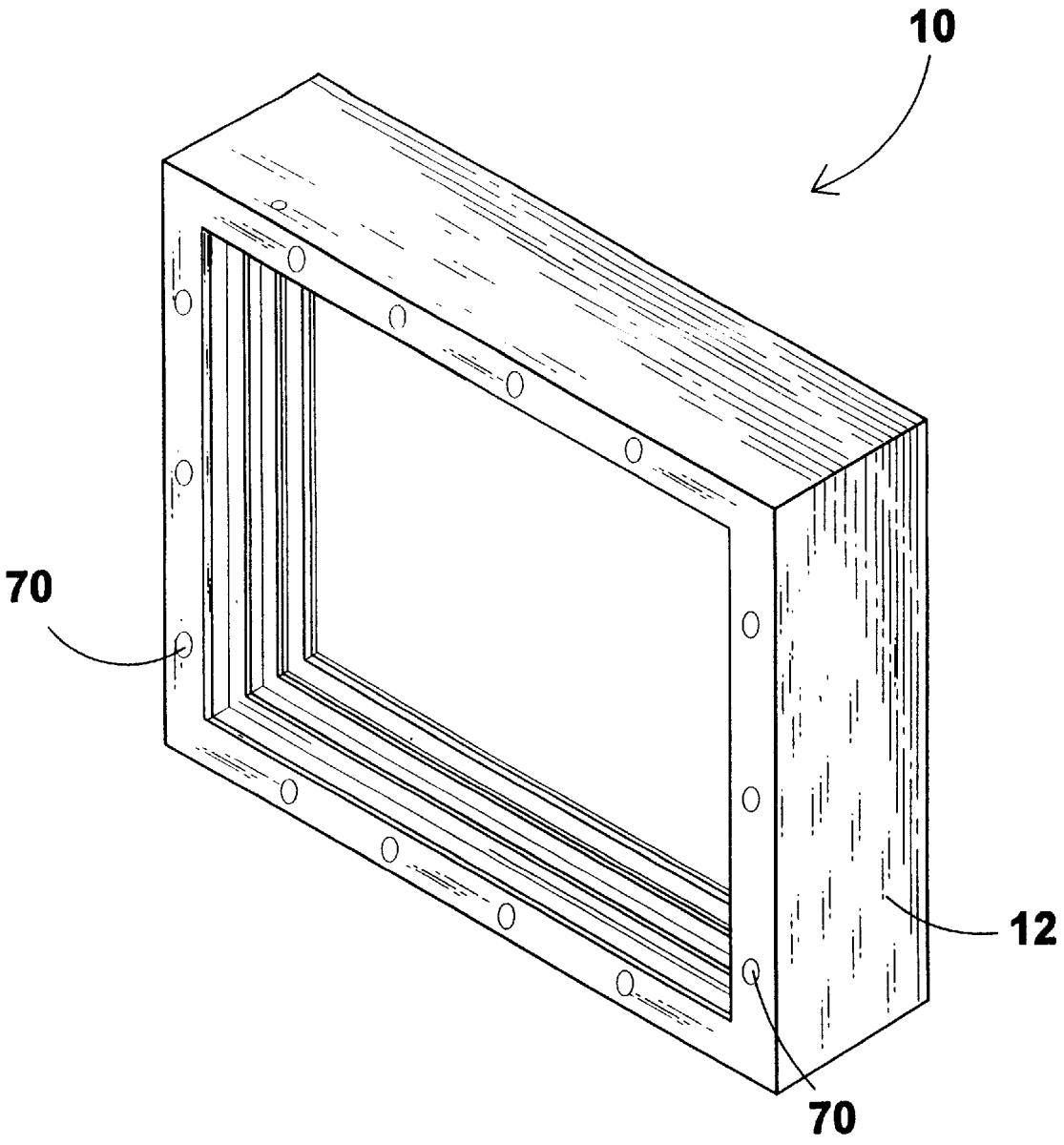
FIG. 9 is a perspective view of an additional embodiment of the new or replacement window frame member having means for securing the new or replacement window frame to the interior surface of the rough opening.

Turning to FIG. 9, shown therein is a perspective view of an additional embodiment of the new or replacement window frame member 12 being a pre-sized, pre-squared, ready to install shutter frame for use with pre-existing windows. Shown is the new or replacement window frame 12 having means 70 for securing the new or replacement window frame 12 to the wall of the rough opening using apertures 70 located in the outer frame member 12 for receiving fasteners (not shown) for securing frame 12. After installation, apertures 70 are plugged shut to hide the fasteners. Apertures 70 are disposed parallel to said outer window frame 12 and communicate with the interior and exterior of the frame 12.

Figure 10:
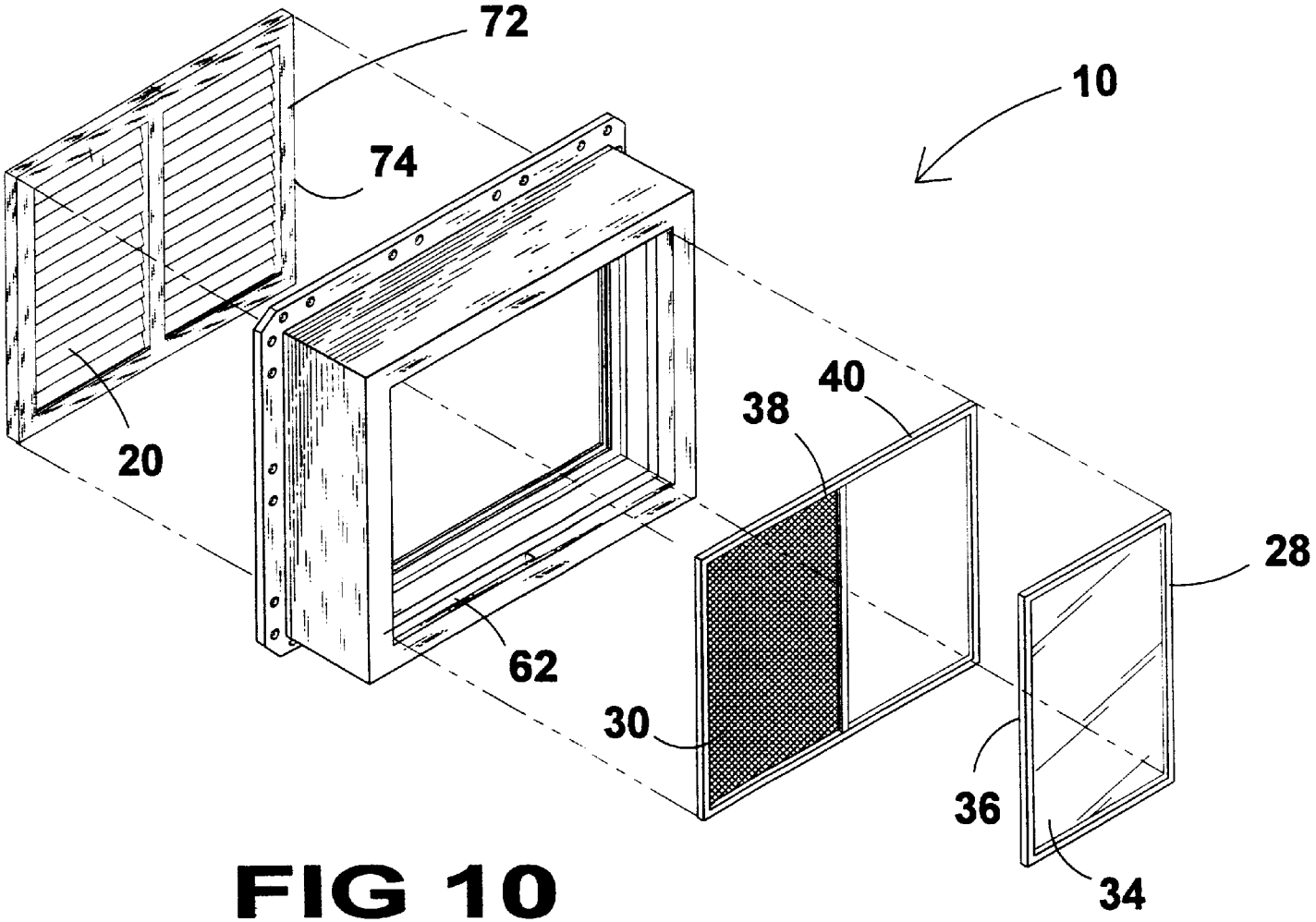
FIG. 10 is an exploded view of an alternate embodiment of the present invention.

Turning to FIG. 10, shown therein is an exploded view of an alternate embodiment of the present invention 10. Shown is a new or replacement window comprising a single track storm shutter 72, which is placed in the exterior track thereby protecting the interior glass members 28 from breakage, and a pair of window pane members 24, and a screen member 30. The shutter member 72 is comprised of a frame 74 having a plurality of non-movable horizontal slats 20. Each of the window pane members 34 is comprised of a pane of transparent material, such as glass or plastic, enclosed within a rigid frame 36. One of the window pane members is non-slidable and the other is selectable slidable the width of the frame member. The screen member 30 is comprised of screen material 38 encompassed by a rigid frame 40. All of the track window members are removable by raising said member until it clears the bottom lip of the channel 62 and swinging them out as previously described.

What is claimed to be new and desired to be protected by Letters Patent is set forth in the appended claims:

1. An apparatus for a window for placement in a rough opening in a wall of a structure, comprising:

a) an outer frame member;

b) means for securing said outer frame member to the rough opening in a wall;

c) a plurality of tracks formed on the inside surface of said outer frame member;

d) a pair of shutters slidably mounted on separate tracks on an innermost side of said outer frame member;

e) a first window slidably mounted in a another one of said tracks, said window extending alone about one half the length of its track;

f) a fixed frame containing a screen and a second window each occupying about half of said fixed frame mounted in still another of said tracks located at an outermost side of said outer frame member, said first window being slidable between a first position covering said second window and a second position covering said screen;

g) said shutters each including a plurality of generally horizontal slats, some of said slats being rotative and adjustable and some of said slats being stationary, a generally upright tilt bar for rotating the adjustable slats of each of said shutters.

2. The apparatus of claim 1, wherein said plurality of tracks are deeper at a top of said outer frame member than a bottom of said outer frame member, whereby said shutters, said windows, and said screen can be removed.

3. The apparatus of claim 1 further comprising a plurality of spring tensioned pins, one pin of which plurality of pins is mounted to extend into each rotative slat, said pin mounted generally horizontally in an inner face of said outer frame member, said inner face of said outer frame member having a plurality of apertures corresponding to each of said rotative slats, a said spring tensioned pin mounted in each of said apertures.

4. The apparatus of claim 1, said pair of shutters further comprising a plurality of rollers mounted on the base of said shutter, said rollers operating in said tracks for slidably mounting said shutters in said tracks.

* * * * *